US006244922B1

(12) United States Patent
Kang

(10) Patent No.: US 6,244,922 B1
(45) Date of Patent: Jun. 12, 2001

(54) ORNAMENTAL MOTION TOY WITH A BOOK-SHAPED HOUSING

(75) Inventor: Chao-Feng Kang, Taipei Hsien (TW)

(73) Assignee: Chain Fong Toys Co., Ltd., Taipei Hsien (TW)

( * ) Notice: Subject to any disclaimer, the term of this patent is extended or adjusted under 35 U.S.C. 154(b) by 0 days.

(21) Appl. No.: 09/500,528

(22) Filed: Feb. 9, 2000

(51) Int. Cl.[7] ..... A63H 33/38
(52) U.S. Cl. ..... 446/149; 446/358; 40/423
(58) Field of Search ..... 446/147, 149, 446/330, 332, 352, 358, 359; 40/421, 423

(56) References Cited

U.S. PATENT DOCUMENTS 1,723,910 * 8/1929 Aramburu .
2,544,105 * 3/1951 Quick .
2,926,487 * 3/1960 Stone .
5,142,925 * 9/1992 Fauvel ..... 74/54
5,988,684 * 11/1999 Blaustein et al. ..... 281/15.1

* cited by examiner

*Primary Examiner*—Jacob K. Ackun, Jr.
*Assistant Examiner*—Jeffrey D. Carlson
(74) *Attorney, Agent, or Firm*—Rabin & Champagne, P.C.

(57) ABSTRACT

An ornamental motion toy includes a book-shaped housing having a front design and a plurality of windows in the front design, a plurality of ornaments suspended in the windows, a driving unit, a transmission unit driven by the driving unit to move the ornaments in the windows along different paths, light and sound producing means installed in the housing and controlled to produce light and sound effects.

4 Claims, 10 Drawing Sheets

ORNAMENTAL MOTION TOY WITH A BOOK-SHAPED HOUSING

BACKGROUND OF THE INVENTION

The present invention to an ornamental motion toy, and more particularly to such an ornamental motion toy, which comprises a book-shaped housing having a plurality of windows, and a plurality of movable ornaments suspended in the windows, a driving unit, and a transmission unit driven by the driving unit to move the movable ornaments in the windows Regular commercially available book-shaped toys are commonly made for use as cabinet means for keeping accessories or small toy items. Because these book-shaped toys are immovable, they are less attractive. FIGS. 9 and 10 show an ornamental motion toy according to the prior art. This structure of ornamental motion toy comprises a bottom shell A, the bottom shell A comprising a plurality of gear housings A1 and a plurality of through holes A2, a top cover shell B covered on the bottom shell A, the top cover shell B comprising a plurality of axle holes B1 and a plurality of bottom screw holes B2, a plurality of screws respectively inserted through the through holes A2 on the bottoms hell A and threaded into the bottom screw holes B2 on the top cover shell B to fix the top cover shell B and the bottom shell A together, a transmission mechanism C installed in the space between the bottom shell A and the top cover shell B, the transmission mechanism C comprising a drive gear C1, a plurality of transmission gears C2 respectively meshed with the drive gear C1, and a plurality of output gears C3 respectively meshed with the transmission gears C2, the output gears C3 each having a gear shaft C4 respectively extended out of the top cover shell B through the axle holes B1, a plurality of spindles CS, the spindles CS each having a bottom end C51 respectively fixedly connected to the gear shafts C4 of the output gears C3 and a top end fixedly mounted with a driven gear C52, and a plurality of ornaments D respectively installed in the axle holes B1 and suspended above the top cover shell B, the ornaments D each having a bottom gear D1 meshed with the driven gear C52 at one spindle C5. Further, a reversible motor (not shown) is controlled to turn the drive gear C1 clockwise and counter-clockwise alternatively, causing the ornaments D to be rotated clockwise and counter-clockwise alternatively above the top cover shell B. This ornamental motion toy is complicated and bulky. Further, the ornaments D can only be driven to make a rotary motion.

SUMMARY OF THE INVENTION

It is one object ob the present invention to provide an ornamental motion toy, which drives different ornaments to move back and forth in different directions along different paths. It is another object of the present invention to provide an ornamental motion toy, which produces sound and light effects. According to one aspect of the present invention, the ornamental motion toy comprises a housing formed of a front cover shell and a back cover shell, the front cover shell having a design and a plurality of windows in the design, a driving unit installed in the housing near a back side, the driving unit comprising a motor, a plurality of transmission gears, and a plurality of output gears respectively coupled to the motor through the transmission gears, the output gears each comprising an eccentric rod; a transmission unit installed in the housing in front of the driving unit, the transmission unit comprising a partition frame, the partition frame comprising a plurality of circular through holes, which receive the driving rod of each output gear of the driving unit for enabling the driving rod to be moved along the periphery of the corresponding circular through hole during operation of the driving unit, and a plurality of fixed guide blocks respectively disposed below the circular through holes, a plurality of transmission plates respectively coupled to the driving rods of the output gears of the driving unit and moved alternatively up and down during operation of the driving unit, the transmission plates each comprising a transverse sliding slot coupled to the driving rod of one output gear of the driving unit, a longitudinal sliding slot coupled to one fixed guide block at the partition frame, and a coupling hole in one corner thereof, and a plurality of holder frames formed integral with one another and disposed between the windows and the transmission plates, the holder frames each comprising a sliding slot; and a plurality of movable ornaments respectively coupled to the holder frames by a slip joint and driven to move in the windows by the driving unit, the movable ornaments each comprising a driving rod inserted through the sliding slot on the corresponding holder frame and coupled to the coupling hole on one transmission plate for enabling the respective movable ornamental to be moved along the first sliding slot on the corresponding holder frame during operation of the driving unit. According to another aspect of the present invention, sound producing means and light producing means are respectively installed in the housing, and controlled to produce light and sound respectively.

BIREF DESCRIPTION OF THE DRAWINGS

DETAILED DESCRIPTION OF THE PREFERRED EMBODIMENT

Figure 1:
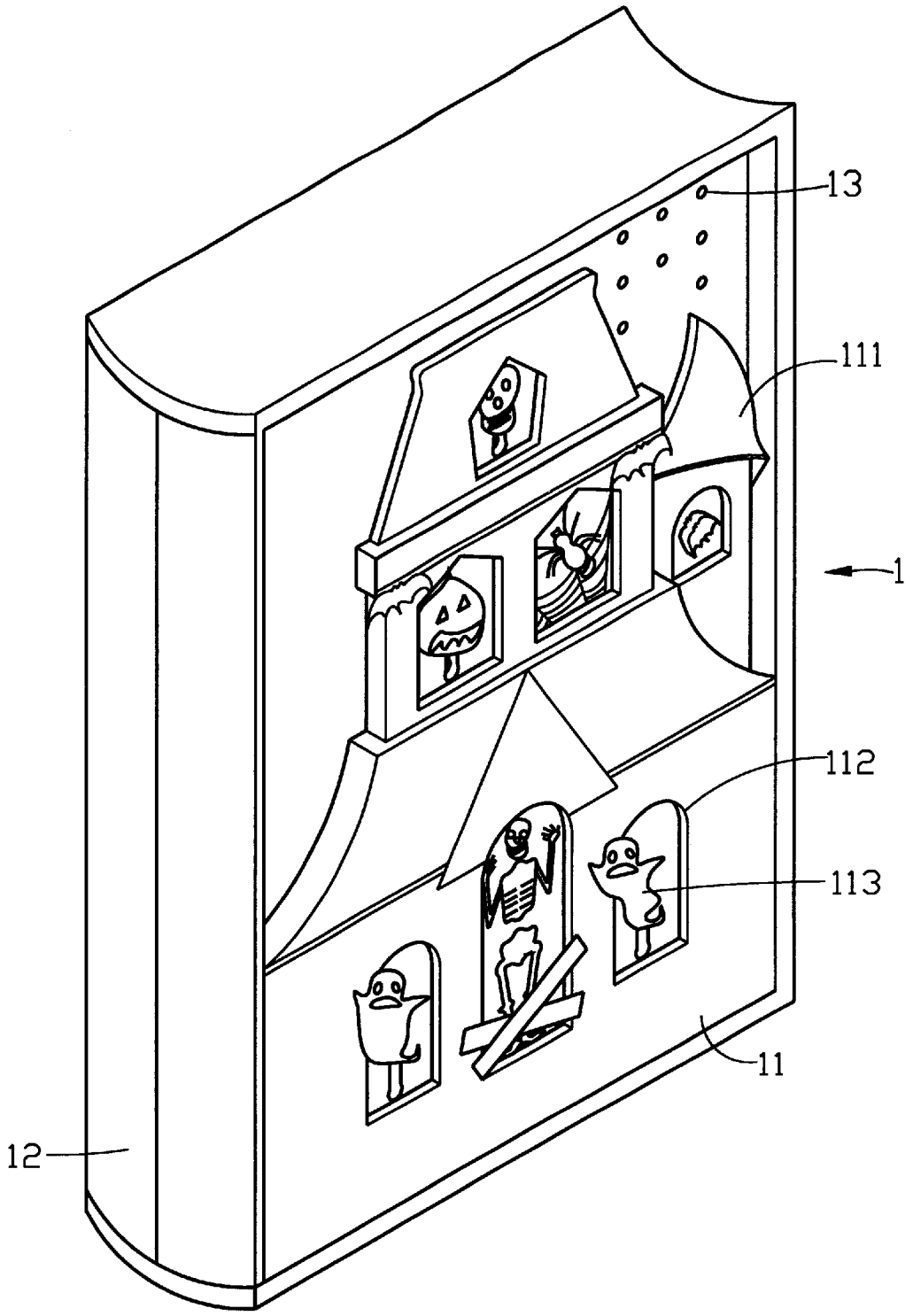
FIG. 1 is a perspective view of an ornamental motion toy according to the present invention.
Figure 2:
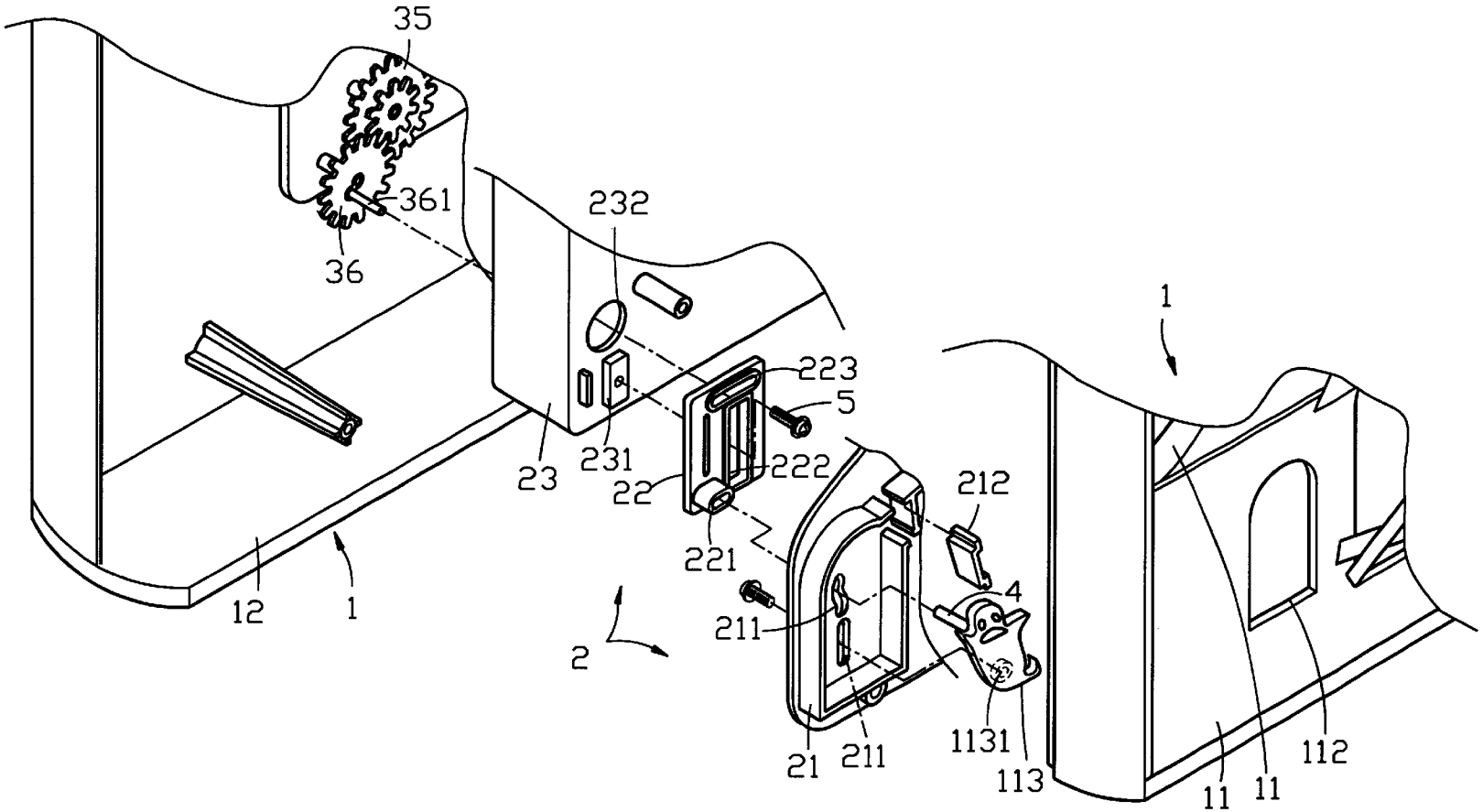
FIG. 2 is an exploded view of a part of the ornamental motion toy shown in FIG. 1.
Figure 3:
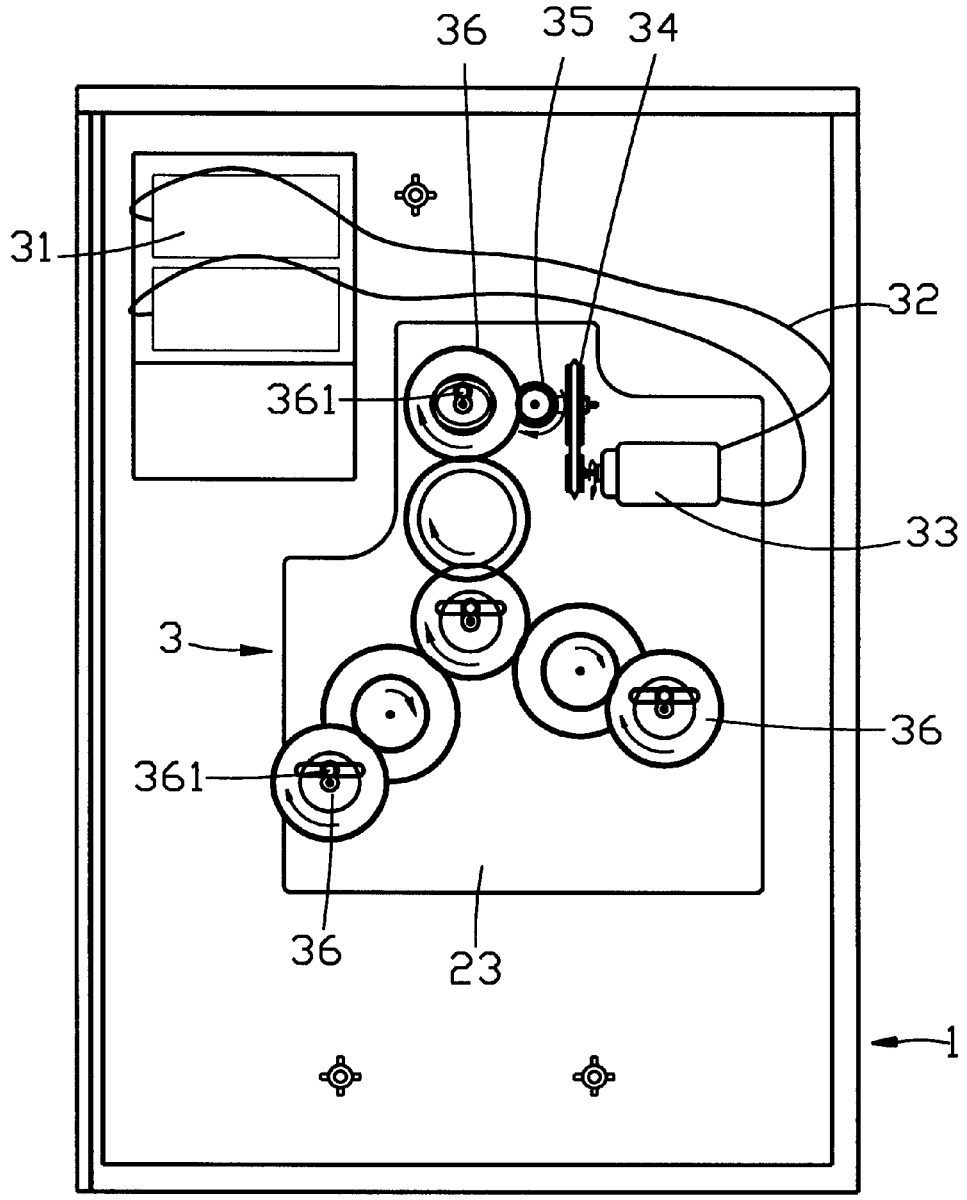
FIG. 3 is a front plain view of the driving unit for the ornamental motion toy shown in FIG. 1.
Figure 4:
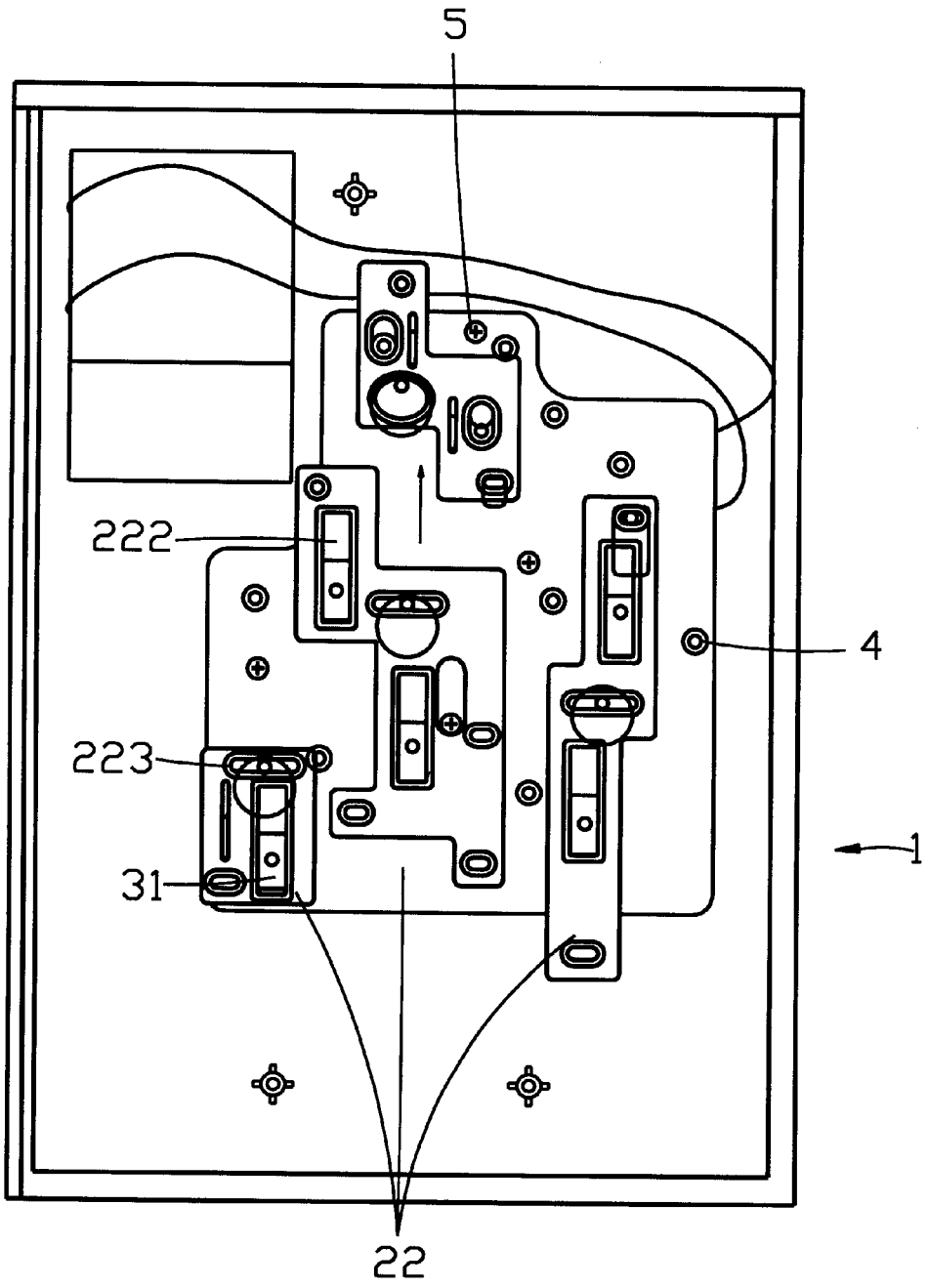
FIG. 4 is a front plain view of the transmission unit for the ornamental motion toy shown in FIG. 1.
Figure 5:
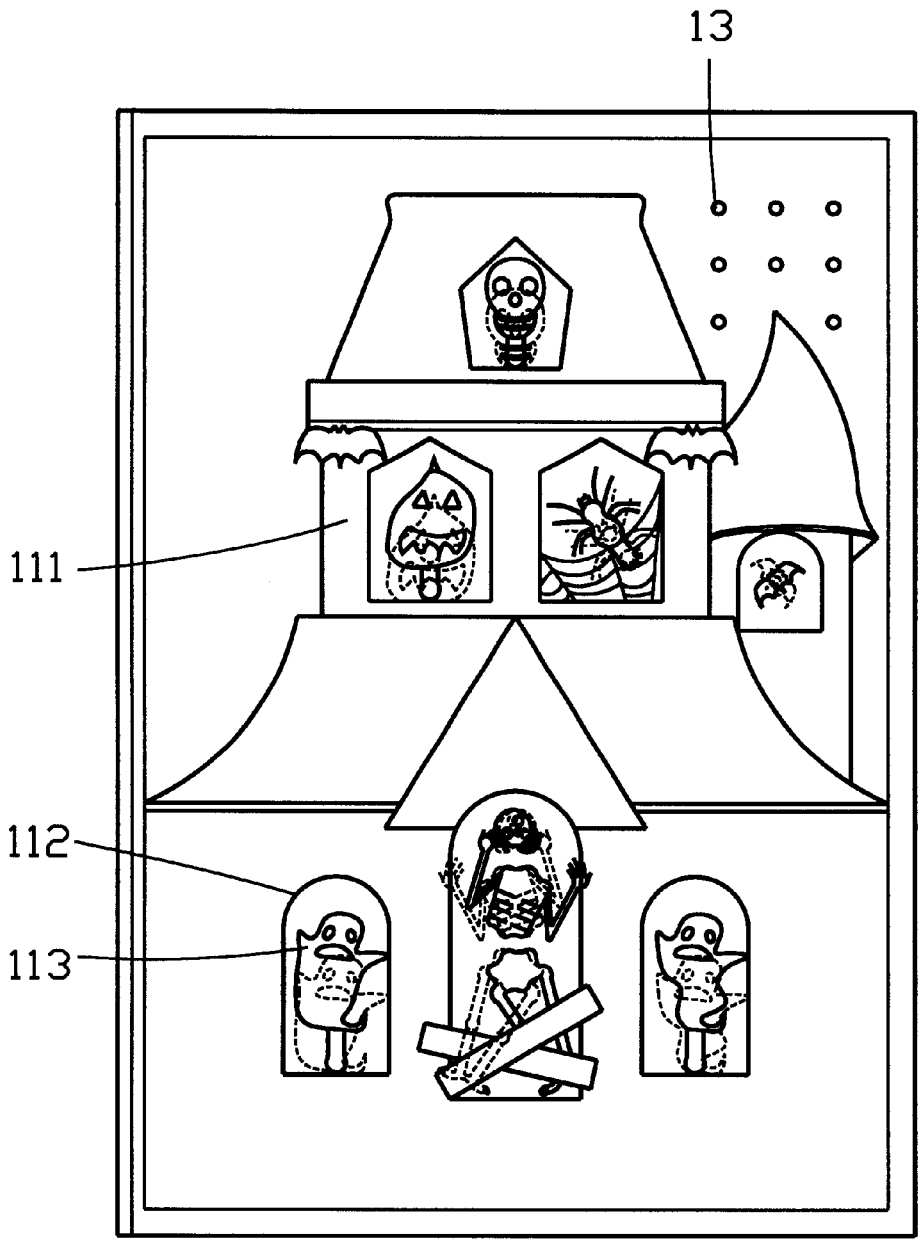
FIG. 5 is a front plain view of the ornamental motion toy shown in FIG. 1.
Figure 6:
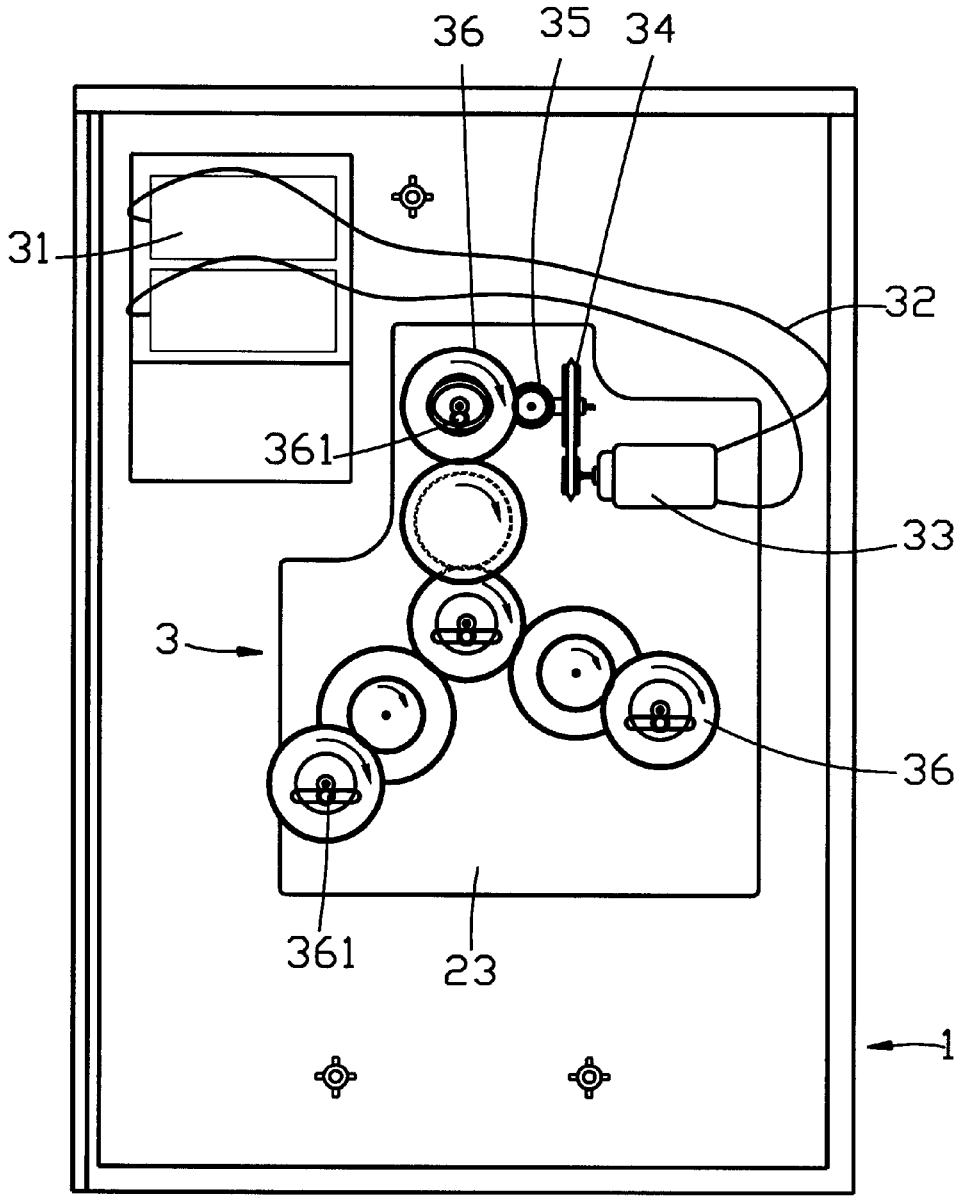
FIG. 6 illustrates the driving unit operated according to the present invention.

Referring to FIGS. from 1 through 3, an ornamental motion toy in accordance with the present invention is generally comprised of a housing 1, a transmission unit 2, and a driving unit 3.

The housing 1 is shaped like a book comprising a front cover shell 11 and a back cover shell 12. The front cover shell 11 has a design 111, a plurality of through holes 13 outside the design 111, and a plurality of windows 112 in the design 111. Further, dolls 113 are respectively moved in the windows 112.

The transmission unit 2 comprises a plurality of holder frames 21 respectively aimed at the windows 112 in the design 111 at the front cover shell 11, the holder frames 21 each having two sliding slots 211 disposed at different elevations and a cover strip 212 covered on one side opening thereof, a plurality of transmission plates 22 respectively disposed behind the holder frames 21, the transmission plates 22 each having a coupling hole 221 in a left bottom corner, a longitudinal slot 222, and a transverse slot 223, and a partition frame 23 disposed behind the transmission plates 22 in front of the driving unit 3, the partition frame 23 having a plurality of circular through holes 232 and a plurality of fixed guide blocks 231 respectively inserted into the longitudinal slot 222 on each transmission plate 22.

The driving unit 3 is mounted in between the back cover shell 12 and the partition frame 23, comprising a power adapter 31, a motor 33 connected to the power adapter 31 by conductors 32, a belt transmission mechanism 34 coupled to the motor 33, a plurality of output gears 36, and a plurality of transmission gears 35 respectively coupled between the belt transmission mechanism 34 and the output gears 36, and a plurality of driving rods 361 respectively eccentrically extended from the output gears 36 and inserted through the through holes 232 on the partition frame 23 and the transverse slot 223 on each transmission plate 22.

Referring to FIGS. from 2 through 5, the dolls 113 are respectively received in the holder frames 21 and facing the windows 112 in the front cover shell 11 of the housing 1, each having a back rod 4 inserted through the upper sliding slot 211 on the corresponding holder frame 21 and coupled to the coupling hole 221 on one transmission plate 22 and a back screw hole 1131 coupled to the lower sliding slot 211 on the corresponding holder frame 21 by a screw. After installation of the transmission unit 2 and the driving unit 3 in the housing 1, the front cover shell 11 and the back cover shell 12 are fastened together by fastening elements, for example, screws 5.

Figure 7:
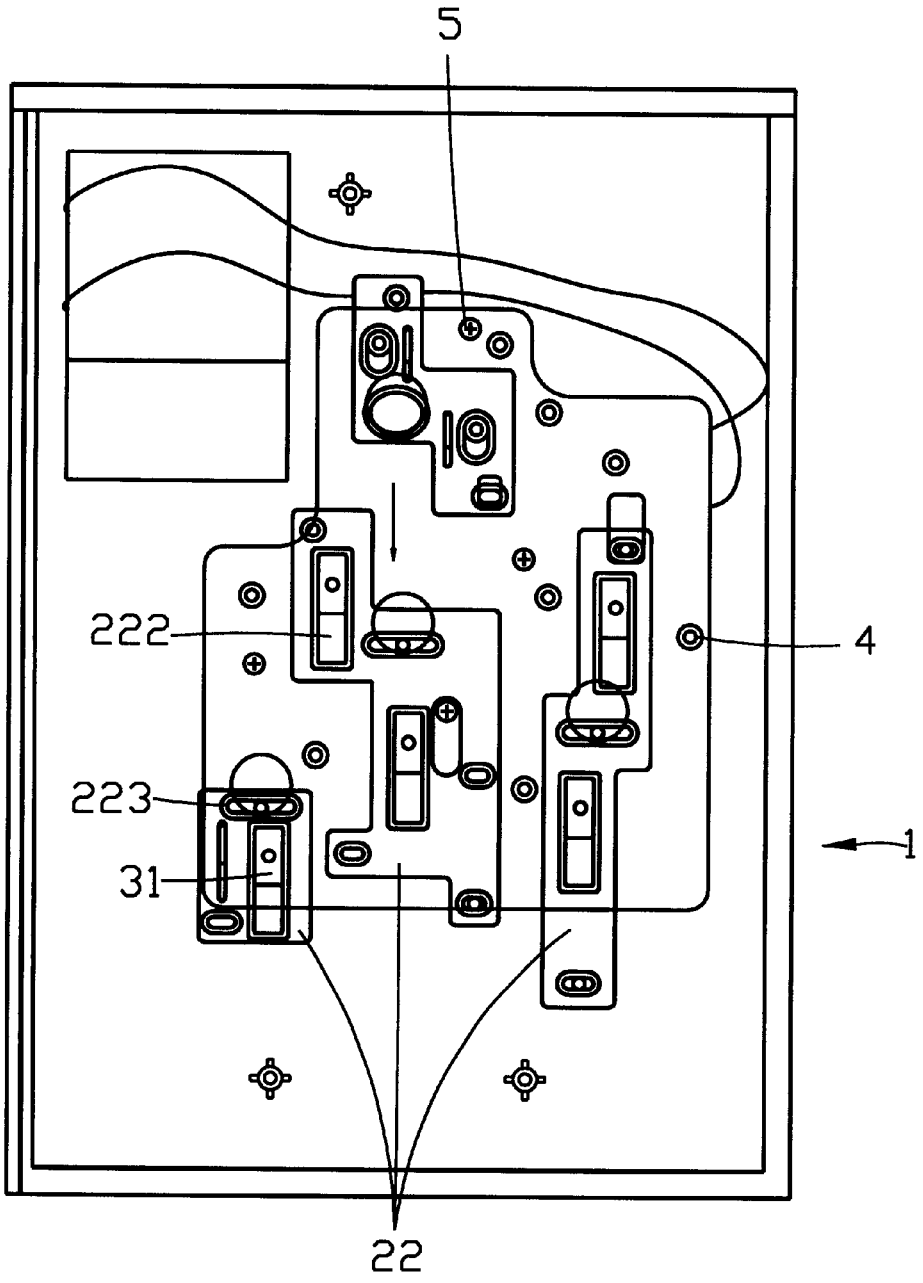
FIG. 7 illustrates the transmission unit operated according to the present invention.
Figure 8:
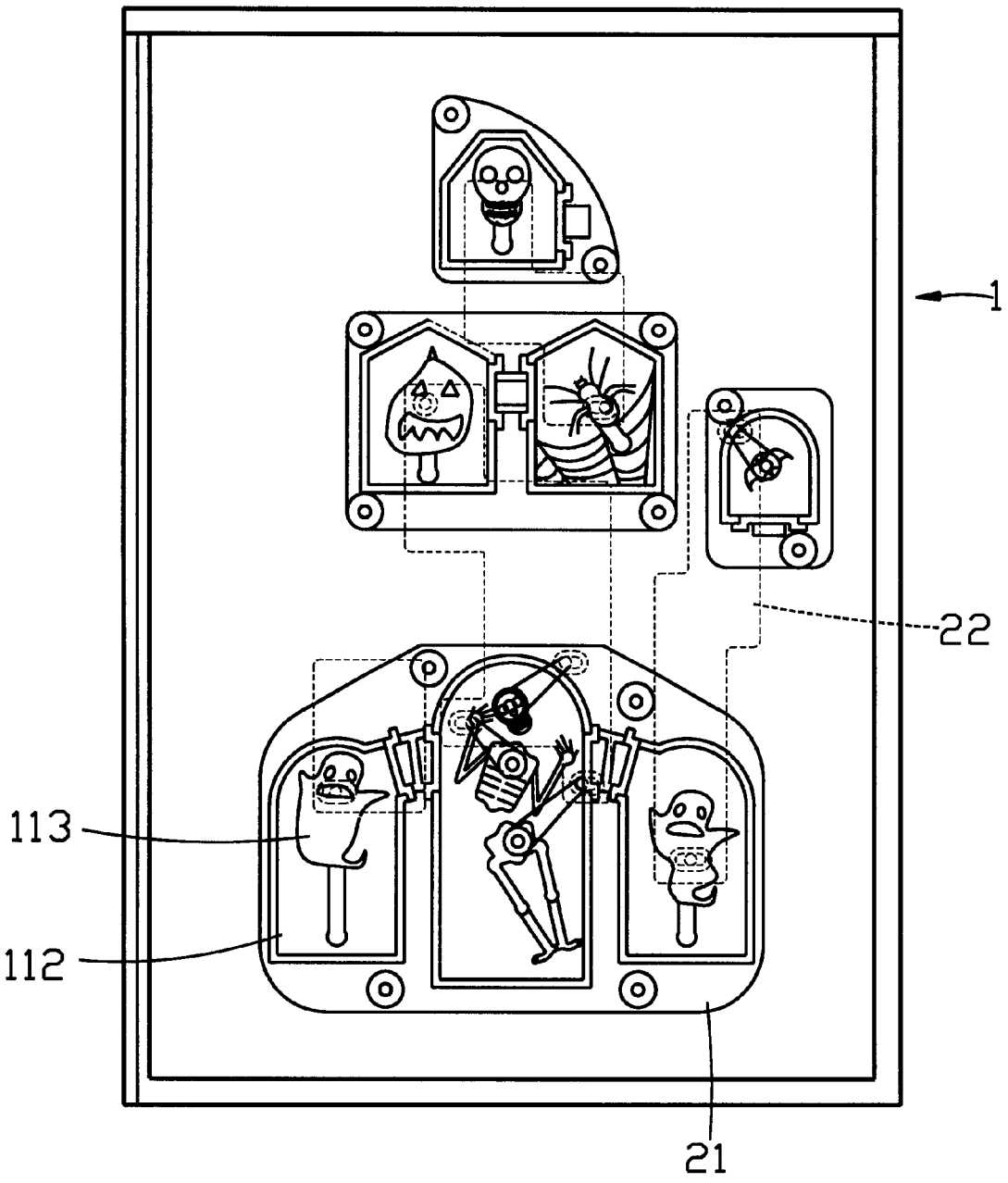
FIG. 8 illustrates the movable ornaments moved in the windows in the housing according to the present invention.
Figure 9:
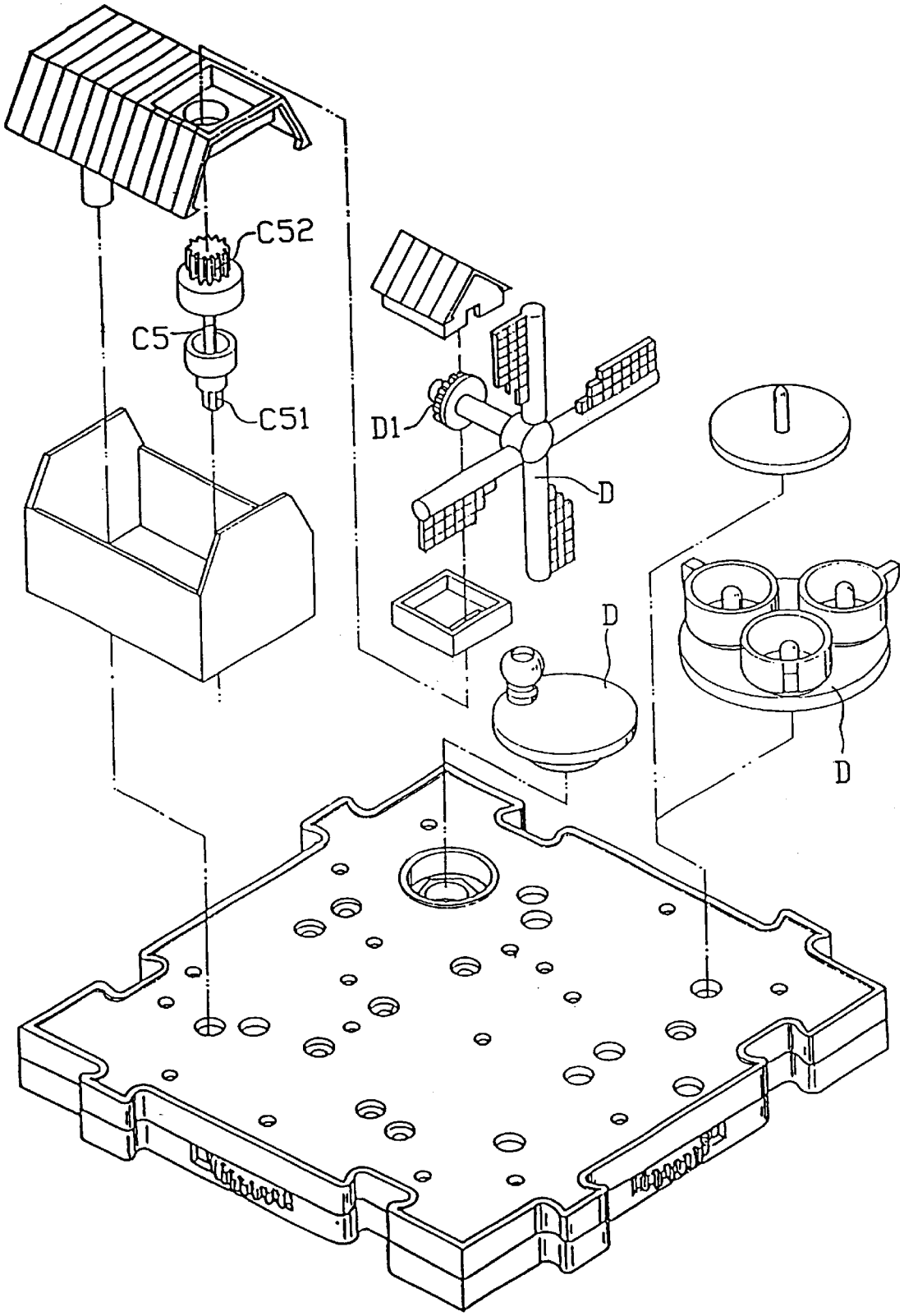
FIG.9 PRIOR ART
FIG. 9 is an exploded view of a motion toy according to the prior art.
Figure 10:
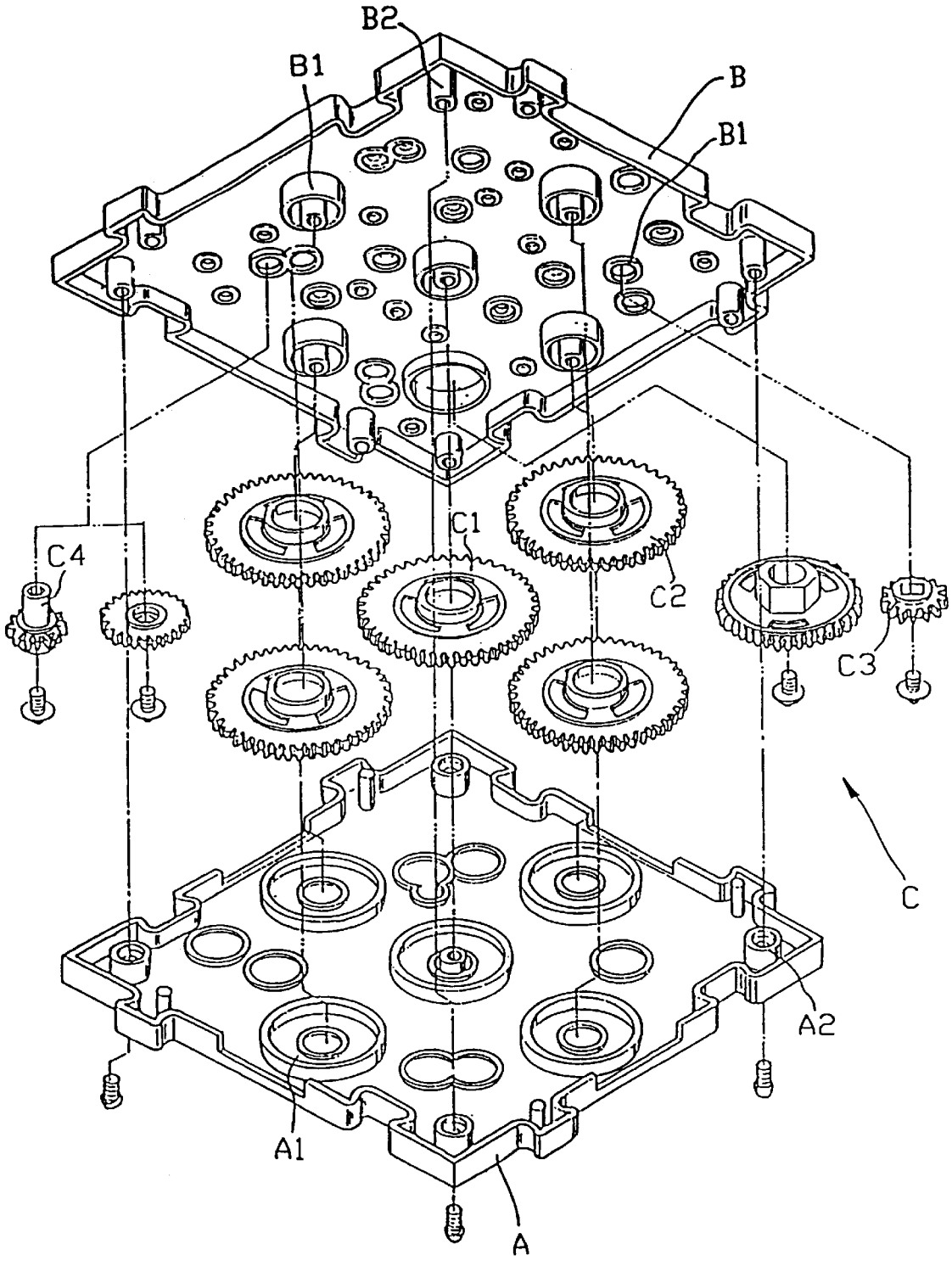
FIG. 10 PRIOR ART
FIG. 10 is an exploded view of a part of the motion toy shown in FIG. 9.

Referring to FIGS. 7 and 8, when the power adapter 3 is switched on, the motor 33 is started to turn the belt transmission mechanism 34, the transmission gears 35, and the driving gears 36, causing the driving rod 361 to be turned along the periphery of the corresponding circular through hole 232, and therefore the transmission plates 22 are respectively alternatively moved up and down. When the transmission plates 22 are alternatively moved up and down, the dolls 113 are respectively driven by the transmission plates 22 to move along the respective sliding slots 211 on the respective holder frames 21. The sliding slots 211 have different shapes, enabling the dolls 113 to be moved back and forth along different paths. Further, sound-producing means may be installed inside the housing 1 corresponding to the through holes 13, and driven to produce a sound effect. The housing 1 may be decorated with lighting means for producing a lightening effect.

While only one embodiment of the present invention has been shown and described, it will be understood that various modifications and changes could be made thereunto without departing from the spirit and scope of the invention disclosed.

What the invention claimed is:

1. An ornamental motion toy comprising:

a housing, said housing comprising a plurality of windows;

a driving unit installed in said housing near a back side, said driving unit comprising a motor, a plurality of transmission gears, and a plurality of output gears respectively coupled to said motor through said transmission gears, said output gears each comprising an eccentric rod;

a transmission unit installed in said housing in front of said driving unit, said transmission unit comprising a partition frame, said partition frame comprising a plurality of circular through holes, which receive the driving rod of each output gear of said driving unit for enabling the driving rod to be moved along the periphery of the corresponding circular through hole during operation of said driving unit, and a plurality of fixed guide blocks respectively disposed below said circular through holes, a plurality of transmission plates respectively coupled to the driving rods of the output gears of said driving unit and moved alternatively up and down during operation of said driving unit, said transmission plates each comprising a transverse sliding slot coupled to the driving rod of one output gear of said driving unit, a longitudinal sliding slot coupled to one fixed guide block at said partition frame, and a coupling hole in one corner thereof, and a plurality of holder frames formed integral with one another and disposed between said windows and said transmission plates, said holder frames each comprising a sliding slot; and a plurality of movable ornaments respectively coupled to said holder frames by a slip joint and driven to move in said windows by said driving unit, said movable ornaments each comprising a driving rod inserted through the sliding slot on the corresponding holder frame and coupled to the coupling hole on one transmission plate for enabling the respective movable ornamental to be moved along the first sliding slot on the corresponding holder frame during operation of said driving unit.

2. The ornamental motion toy of claim 1 wherein said housing is comprised of a front cover shell and a back cover shell fastened together, said front cover shell having a design in which said windows is disposed.

3. The ornamental motion toy of claim 1 wherein said holder frames each have a side opening and a cover strip covered on said side opening.

4. The ornamental motion toy of claim 1 wherein said driving unit further comprising power supply means connected to said motor by conductors and controlled to provide electricity to said motor, and a transmission belt coupled between said motor and said transmission gears.

* * * * *